US006139127A

United States Patent [19]

Kato et al.

[11] Patent Number: 6,139,127

[45] Date of Patent: Oct. 31, 2000

[54] INK-JET RECORDING METHOD FOR REDUCING WHITE BLUR AND RECORDING APPARATUS FOR PRACTICING THE METHOD

[75] Inventors: Minako Kato, Yokohama; Masao Maeda, Kawasaki; Miyuki Fujita, Tokyo, all of Japan

[73] Assignee: Canon Kabushiki Kaisha, Tokyo, Japan

[21] Appl. No.: 08/997,794

[22] Filed: Dec. 24, 1997

[30] Foreign Application Priority Data

Dec. 27, 1996 [JP] Japan ..... 8-349627
May 12, 1997 [JP] Japan ..... 9-121015

[51] Int. Cl.[7] ..... B41J 2/205

[52] U.S. Cl. ..... 347/15

[58] Field of Search ..... 347/15, 96, 98, 347/43

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/56 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 5,044,796 | 9/1991 | Lund | 400/323 |
| 5,623,294 | 4/1997 | Takizawa | 347/98 |
| 5,640,187 | 6/1997 | Kashiwazaki et al. | 347/96 |
| 5,751,310 | 5/1998 | Yano et al. | 347/43 |
| 5,933,164 | 8/1999 | Sato et al. | 347/43 |

FOREIGN PATENT DOCUMENTS

| | | |
|---|---|---|
| 53-24486 | 3/1978 | Japan . |
| 54-43733 | 4/1979 | Japan . |
| 56-150396 | 11/1980 | Japan . |
| 58-12862 | 8/1983 | Japan . |
| 59-123670 | 7/1984 | Japan . |
| 59-138461 | 8/1984 | Japan . |
| 2-233275 | 9/1990 | Japan . |

*Primary Examiner*—John Barlow
*Assistant Examiner*—Juanita Stephens
*Attorney, Agent, or Firm*—Fitzpatrick, Cella, Harper & Scinto

[57] ABSTRACT

An ink-jet recording method and a recording apparatus used in the method detect a blank region of an image, and enable backward printing only when detecting those blanks at the top and bottom ends of a region where printing can be performed by one scan. The ink-jet recording method and the recording apparatus prevent irregular images, that would otherwise be caused by consecutive rows printed by the backward printing, and execute forward and backward printing while reducing the color difference between the printing directions so that a high-quality output can be obtained at high speed. As a result, when ink is ejected before the ejection of a print-characteristic improving liquid, the image quality of a border in contact with a region including the print-characteristic improving liquid in the main-scan direction and the sub-scan direction can be improved.

14 Claims, 13 Drawing Sheets

| | BREAK BETWEEN PRESENT AND PREVIOUS SCANS | BREAK BETWEEN PRESENT AND SUBSEQUENT SCANS |
|---|---|---|
| REGION a | PRESENT | MISSING |
| REGION b | MISSING | PRESENT |
| REGION c | PRESENT | MISSING |
| REGION d | MISSING | MISSING |

| | BREAK BETWEEN PRESENT AND PREVIOUS SCANS | BREAK BETWEEN PRESENT AND SUBSEQUENT SCANS |
|---|---|---|
| REGION e | PRESENT | MISSING |
| REGION f | MISSING | PRESENT |
| REGION g | PRESENT | PRESENT |
| REGION h | PRESENT | MISSING |

FIG. 2A

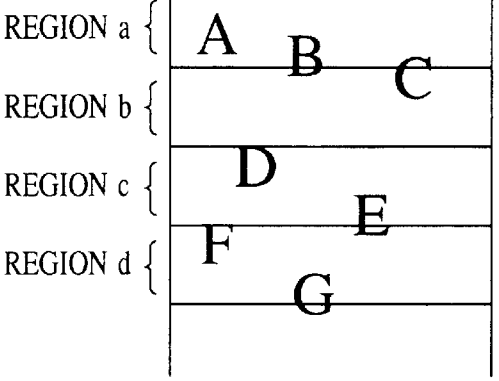

PRINTING DIRECTION

| REGION | BREAK BETWEEN PRESENT AND PREVIOUS SCANS | BREAK BETWEEN PRESENT AND SUBSEQUENT SCANS |
|---|---|---|
| REGION a | PRESENT | MISSING |
| REGION b | MISSING | PRESENT |
| REGION c | PRESENT | MISSING |
| REGION d | MISSING | MISSING |

FIG. 2B

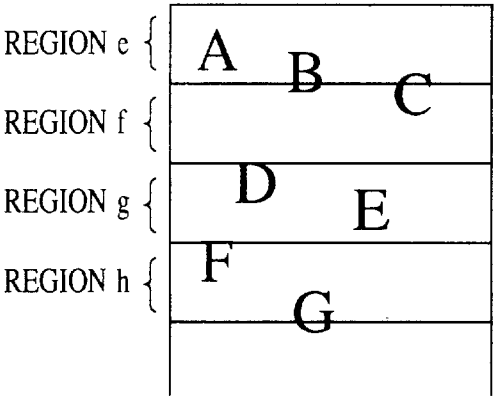

PRINTING DIRECTION

| REGION | BREAK BETWEEN PRESENT AND PREVIOUS SCANS | BREAK BETWEEN PRESENT AND SUBSEQUENT SCANS |
|---|---|---|
| REGION e | PRESENT | MISSING |
| REGION f | MISSING | PRESENT |
| REGION g | PRESENT | PRESENT |
| REGION h | PRESENT | MISSING |

FIG. 8A-PRIOR ART
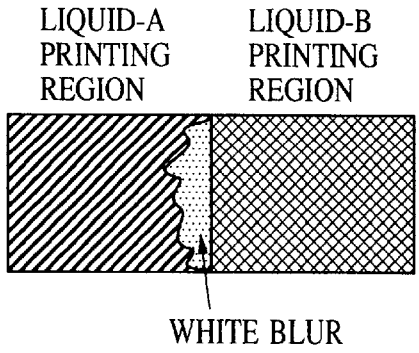
FIG. 8B-PRIOR ART
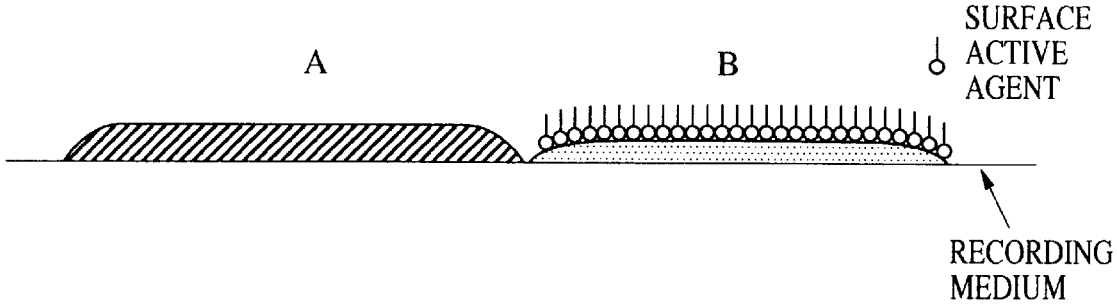
FIG. 8C-PRIOR ART
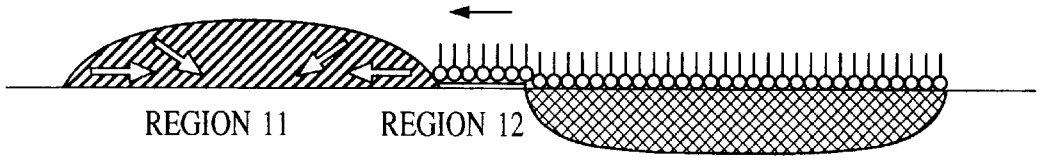
FIG. 8D-PRIOR ART
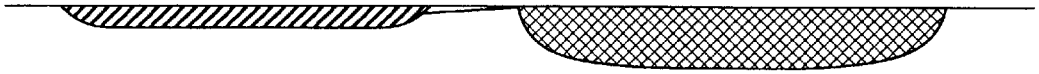

FIG. 9A-PRIOR ART
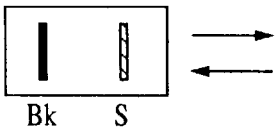
FIG. 9B-PRIOR ART
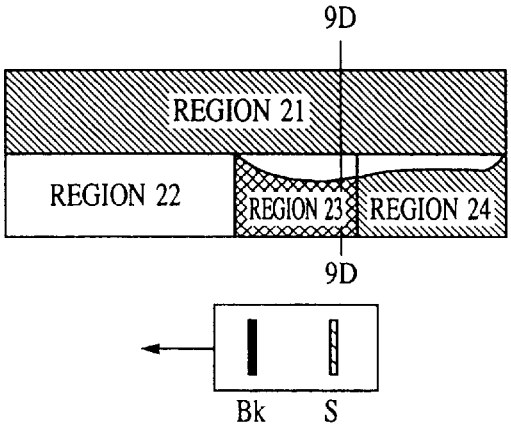
FIG. 9C-PRIOR ART
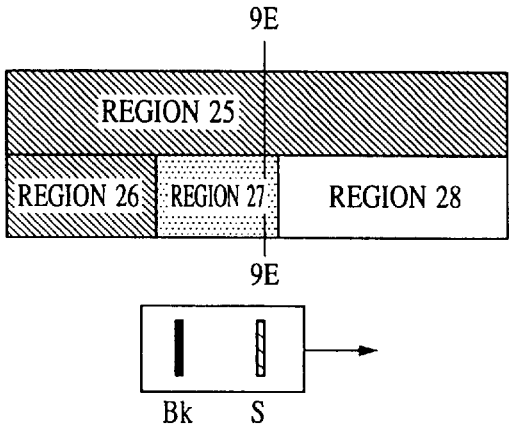
PRINT REGION WITH INK ONLY USED
PRINT REGION WITH PRINT-CHARACTERISTIC IMPROVEMENT LIQUID ONLY USED
PRINT REGION WITH PRINT-CHARACTERISTIC IMPROVEMENT LIQUID AND INK USED
FIG. 9D-PRIOR ART
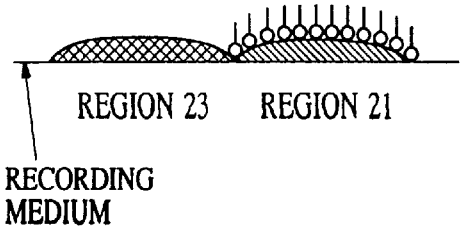
FIG. 9E-PRIOR ART
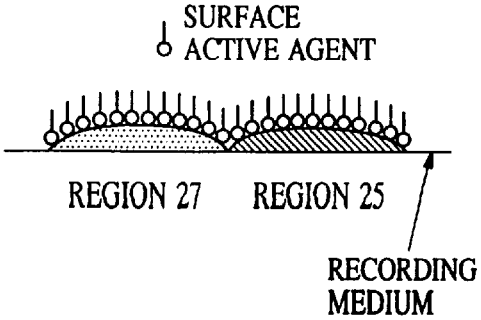

INK-JET RECORDING METHOD FOR REDUCING WHITE BLUR AND RECORDING APPARATUS FOR PRACTICING THE METHOD

BACKGROUND OF THE INVENTION

1. Field of the Invention

The present invention relates to ink-jet recording methods and recording apparatuses capable of providing high-quality images on a recording medium, and in particular, to an ink-jet recording method for discharging a printing-characteristic improving liquid causing recording ink on a recording medium and coloring material in the recording ink to become insoluble or to aggregate, and a recording apparatus for practicing the ink-jet recording method, which both enable high-speed printing. The ink-jet recording method and the apparatus are applicable specifically to office equipment with the recording apparatus as output means, such as printers, photocopiers and word processors, and manufacturing equipment such as textile printers for printing on textiles.

2. Description of the Related Art

The ink-jet recording technique is conventionally used in printers, photocopiers and so forth because of that technique has advantages such as low noise, and reduced-size recording units.

When an image is formed on a recording material of the type known as "plain paper" using a recording apparatus employing ink-jet recording, the image formed is not water-fast; the image may run if it becomes wet. When a color image is formed by ink-jet recording, it is practically impossible to produce a highly concentrated image without feathering and without blurring between colors. Thus, a color image having the desired image durability and quality cannot be obtained.

In order to improve the water resistance of an image, ink having waterproof coloring material has recently been used for practical use. However, since in principle the ink still has insufficient water resistance, and becomes almost insoluble in water after it is dried, the ink easily clogs recording-head nozzles. Accordingly, to prevent such clogging, the recording apparatus structure must be complicated.

A number of techniques for improving the durability of a recording medium have been disclosed. In Japanese Patent Laid-Open No. 53-24486, there is disclosed a technique for changing dye into color lake to fix by the postprocessing of dyed material in order to improve the dyed material durability against humidity.

In Japanese Patent Laid-Open No. 54-43733, there is disclosed a method in which recording is performed by the ink-jet recording method using two or more components for increasing film-formation ability in touching mutually at normal temperature or when they are heated. This provides a print having a film strongly adhered to the recording medium when the components on the recording medium are caused to touch one another.

In Japanese Patent Laid-Open No. 55-150396, there is disclosed a method for providing a waterproof agent for forming color lake after performing ink-jet recording with water-dye ink.

In Japanese Patent Laid-Open No. 58-128862, there is disclosed an ink-jet recording method for recording by sequentially providing recording ink and processing liquid after recognizing in advance the position of an image to be recorded. According to the ink-jet recording method, recording is performed with the processing liquid after using the recording ink, the processing liquid being applied to the recording ink previously provided, or the recording ink being applied to the previously provided processing liquid before providing fresh processing liquid thereon.

In the above Japanese Patent Applications there are not disclosed restoration means for maintaining discharging reliability, a head structure, a container structure, printing modes for improving a recording image quality, and so forth, which are characteristic in the ink-jet recording apparatus.

In addition, images can be printed at high speed using a bi-directional printing method which scans by moving a carriage in two directions. Such bi-directional printing causes an image-quality difference due to the shift in the position of ink provided by bi-directional scanning, and a color difference due to the different order in which the several different color inks are applied.

When a recording head for the processing liquid and a recording head for the ink are arranged in the main-scan direction, the order in which the processing liquid and the ink are provided is reversed from one direction of scan to the other. The processing liquid often causes the ink color to change. The ensuing color variation is readily seen when one compares the case where recording is performed by applying the processing liquid before the ink and the case where recording is performed by applying the ink before the processing liquid.

For the foregoing reasons, when part of an image printed in one direction and an adjacent part of the image is printed in another direction, the color and image-quality difference between the adjacent parts appear strongly, which disadvantageously causes noticeable image-quality deterioration.

According to Japanese Patent Laid-Open No. 2-233275, a break (blank image portion) in an image is detected so that a region to be printed in another direction is not adjacent to the break, which enables bi-directional printing. In this method the printing direction is not reversed unless the break is detected. Printing continues in the same direction as the previous printing direction until the break is detected. One example is shown in FIG. 10. Region a' is printed in the direction from left to right (the "forward" direction). Since a break is not detected between regions a' and b', region b' is printed in the same direction in which region a' was printed. A break exists between regions b' and c'. Thus, when region c' is printed, a carriage moves in the direction opposite to the direction in which the previous region was printed. In other words, region c' is printed in the direction running from right to left (the "backward" direction). Since a break is not detected between regions c' and d', region d' is printed in the same direction in which region c' was printed.

The above method is effective in reducing the difference between the forward-printed color and the backward-printed color or a shift in the position of printed ink and performing the bi-directional printing.

In addition, the present inventors have found that, when a combination of a material having an increased amount of a surface active agent and another material having a reduced amount of a surface active agent, or no surface active agent, is selected from combinations of ink and a print-characteristic improving liquid including a material for improving print characteristics (such as water resistance) of the ink when the ink is provided to a recording medium, an irregular image is generated at the region between scans due to the order of shooting the ink and the print-characteristic improving liquid. The phenomenon and the mechanism of this occurrence will be described below.

The main cause of the irregular image at the region between the scans is a phenomenon in which the concentration of the ink has a distribution such as to form a whitish portion, which is hereinafter referred to as a "white blur" phenomenon. It is thought that the white blur phenomenon is caused by the surface active agent.

FIGS. 8A to 8D illustrate the white blur phenomenon caused by the distribution of the ink concentration on an image border.

FIG. 8A shows an example in which a liquid-A printing region and a liquid-B printing region are mutually in contact. Ink with a relatively high amount of surface active agent is used as liquid A, while ink with a reduced amount of the surface active agent is used as liquid B. As shown in FIG. 8A, the white blur phenomenon occurs in the liquid-A printing region.

In general, adding a surface active agent reduces a liquid's surface tension and increases the liquid's permeability. Ink having high surface tension and low permeability is unlikely to produce the phenomenon of "feathering" in which ink expands along fibers of paper, which means the border between printed part and non-printed part will be clear. Accordingly, ink having low permeability is frequently used as black ink for printing characters. In contrast, ink to which increased amounts of surface active agent have been added has low surface tension and high permeability. Such ink is likely to cause feathering but quickly permeates the recording medium. Thus, this ink causes little ink mixing (called "bleeding") at the contact border between different colors, and is preferably fixative. This type of ink is frequently used as an ink having a color other than black. In many cases, liquid having high permeability is used as the print-characteristic improving liquid in consideration of fixation improvement, discharge characteristics, and so forth.

FIGS. 8B to 8D show the mechanism by which white blur is thought to occur. As shown in FIG. 8C, when liquid (ink) A having low permeability contacts liquid (ink) B having low permeability, the liquids having been applied to a recording medium as shown in FIG. 8B, a surface active agent included in liquid B reaches the edge of liquid A which in contact with liquid B. As a result, liquid A has a region (region 11) where an increased amount of surface active agent is added and there is also a region (region 12) where the amount of surface active agent is reduced. The influence of the inflowing surface active agent causes liquid A, which originally had high surface tension and low permeability, to have low surface tension and high permeability. The high surface tension-portion (region 11) in liquid A concentrates at the center of the liquid-A drop due to the high surface tension itself. Accordingly, the concentration of liquid A has a distribution. Region 11 has a high concentration, while region 12 has a low concentration. The influence of the surface active agent causes liquid A in region 12 to quickly permeate the recording medium, with the low concentration of region 12 being unchanged. As a result, coloring material in the liquid A hardly remains on the surface of the recording medium, and the surface looks whitish, as shown in FIG. 8D.

The white blur occurs not only in the contact border in the main-scan direction in which a recording head and a recording medium are relatively moved in a recording mode but also between different rows in the sub-scan direction in which the recording head and the recording medium are relatively moved in a non-recording mode.

In addition, the occurrence of the white blur is not limited to the case that the liquid-B printing region is formed with only a single liquid. For example, the white blur occurs also when a liquid with a surface active agent and a liquid without a surface active agent are simultaneously put on the liquid-B printing region.

FIGS. 9A to 9E show the occurrence of white blur when black ink (liquid-A type without a surface active agent) and a print-characteristic improving liquid (liquid-B type with a surface active agent) are simultaneously applied.

FIG. 9A schematically shows a monochrome-printing recording head provided with a print-characteristic-improving-liquid (S) discharge outlet represented by diagonal lines and a black ink (Bk) discharge outlet represented by black. The recording head moves on a recording medium in the directions denoted by arrows so that an image is recorded on the recording medium.

FIG. 9B shows a case in which the recording head shown in FIG. 9A performs recording for two rows by moving from right to left on a print region. In this case, a black record image and a print-characteristic-improving-liquid record image overlap. In other words, the print-characteristic improving liquid is ejected after the ink has been ejected. When recording with the print-characteristic improving liquid is performed after performing recording with the ink, white blur is generated on the border between the print regions as shown in FIG. 9B.

Region 21 is an area formed by the previous scan, in which the ink and the print-characteristic improving liquid mix, and the effect of the print-characteristic improving liquid causes coloring material in the ink to be insoluble or aggregate. Since the print-characteristic improving liquid has been applied in region 21, its surface active agent exists. With the recording head moving from right to left, the ink is initially ejected onto the recording medium, and after a lapse of a predetermined time determined by the head width and the moving speed of a carriage, the print-characteristic improving liquid is ejected to form an area where the black ink and the print-characteristic improving liquid mix. Region 22 is a region where nothing is printed. Region 23 is a print region where only the ink is used. Regions 24 is a print region where both the print-characteristic improving liquid and the ink are used, similar to region 21.

FIG. 9D schematically shows a condition just before the white blur seen in FIG. 9B occurs, namely, the same condition as shown in FIG. 8B in the section taken on line 9D—9D shown in FIG. 9B. Region 21 has a large part of the surface active agent included in the print-characteristic improving liquid. Since only the black ink forms region 23, no surface active agent is included in region 23. Region 21 and region 23 come into contact, and the surface active agent in region 21 moves to region 23. Consequently, the distribution (white blur) of the ink concentration is generated on the edge of region 23 as shown in FIG. 9B. In other words, the section shown in FIG. 9D changes consequently to the condition shown in FIG. 8C.

After white blur is generated in black ink in a region, even if a print-characteristic improving liquid is ejected in the region, the white blur cannot be improved. Instead, the effect of the print-characteristic improving liquid causes coloring material to be insoluble or aggregate, with the distribution of the ink concentration unchanged.

FIG. 9C shows the reverse of the case shown in FIG. 9B in which the recording head shown in FIG. 9A performs recording for two rows by moving from left to right. In this case a black record image and a print-characteristic-improvement-liquid record image overlap. In other words, the print-characteristic improving liquid is ejected before the ink. When recording with the print-characteristic improving liquid is performed before performing recording with the ink, white blur as shown in FIG. 9B is not generated on the border between the print regions.

Region 25 shown in FIG. 9C is an area formed by the previous scan, in which the ink and the print-characteristic improving liquid mix. Since the print-characteristic improving liquid is included in region 25, its surface active agent is also included. With the motion of the recording head from left to right, the print-characteristic improving liquid is initially ejected, and after a lapse of a predetermined time, the black ink is ejected to form a region where the black ink and the print-characteristic improving liquid mix. Region 26 is, similar to region 25, a print region in which both the print-characteristic improving liquid and the ink are used. Region 27 is a print region where only the print-characteristic improving liquid is used. Region 28 has no recording.

FIG. 9E schematically shows the section taken on line 9E—9E shown in FIG. 9C.

The print-characteristic improvement liquids have been ejected in both regions 25 and 27. Thus, surface active agents are present in regions 25 and 27.

The black ink is applied in the print region (region 27) where only the print-characteristic improving liquid is used. However, unlike the case shown in FIG. 9B, when the black ink reaches the recording medium, the print-characteristic improving liquid has been already applied. Accordingly, the concentration of the surface active agent has no distribution, and when the ink comes into contact with the print-characteristic improving liquid, the coloring material becomes insoluble or aggregates quickly, so that white blur cannot occur.

The foregoing cases have been described in connection with monochrome printing. However, a similar phenomenon also occurs when color ink not having a surface active agent is selected.

As described above, the present inventors have found that, when ink is ejected before ejecting a print-characteristic improving liquid, the image quality of a border in contact with a region including the print-characteristic improving liquid may deteriorate remarkably in the main-scan direction and the sub-scan direction.

SUMMARY OF THE INVENTION

The present invention has been made in view of the foregoing problems. Accordingly, it is an object of the present invention to provide an ink-jet recording apparatus and method which detect a blank (break) of an image and enable forward printing only when detecting blanks at the top and bottom ends of a region capable of being printed by one scan, whereby the ink-jet recording apparatus and method prevent irregular images caused by consecutive rows printed by the forward printing, and execute forward and backward printing while reducing the color difference between the printing directions so that high-quality output can be obtained at high speed.

One aspect of this invention pertains to an ink-jet recording method for recording an image by applying ink and print-characteristic improving liquid for improving a print-characteristic of the ink to a recording medium. The ink and print-characteristic improving liquid are applied to the recording medium at a single identical region on the recording medium. This method divides a recording range into regions before either a first step of applying the print-characteristic improving liquid and then the ink to each divided region, in that order, or a second step of applying the ink and then the print-characteristic improving liquid, in that order, determining if an image which is continuous over adjacent regions exists on a border between the adjacent regions. The second step is used to make one region to be used for recording recordable when it is determined in the determining step that the continuous image does not exist on the border between the one region without recording and the one region with recording performed, and that the continuous image does not exist on the border between the one region without recording and the one region to be used for the subsequent recording.

This invention also concerns an ink-jet recording apparatus for recording an image by applying ink and print-characteristic improving liquid for improving a print-characteristic of the ink to a recording medium. The ink and print-characteristic improving liquid are applied to the recording medium at a single identical region on the recording medium by discharging the ink and print-characteristic improving liquid from a recording head. Recording is performed by dividing a recording range into plural regions before either a first step of applying the print-characteristic improving liquid and then the ink to each divided region, in that order, or a second step of applying the ink and then the print-characteristic improving liquid, in that order. The ink-jet recording apparatus has a determination means for determining if an image which is continuous over adjacent regions exists on a border between the adjacent regions, and a recording control means. The recording control means uses the second step to make one region to be used for recording recordable when it is determined by the determination means that the continuous image does not exist on the border between the one region without recording and the one region with recording performed, and that the continuous image does not exit on the border between the one region without recording and one region to be used for the subsequent recording.

The print-characteristic improving liquid consists of liquids including a material which enables the ink to provide preferable characteristics such as water resistance when the print-characteristic improving liquid is provided on the recording medium together with the ink. The liquids include a liquid which, when it contacts the ink, causes the ink to act so that coloring material in the ink becomes insoluble or aggregate, a liquid causing the coloring material in the ink to be insoluble, and a liquid for dispersing coloring material in the ink to break. Causing the coloring material in the ink to be insoluble is, for example, a phenomenon in which anion groups included in a dye in the ink and the cation groups of cationic material included in the print-characteristic improving liquid react mutually as ions to form ionic bonds, and the ionic bonds cause the dye uniformly dissolved in the ink to separate from the solution. The term "aggregate" means "causing the coloring material in the ink to be insoluble" when the coloring material used in the ink is a water soluble dye having anion groups. When the coloring material used in the ink is a pigment, the term "aggregate" means that a pigment dispersion agent or the surface of the pigment and the cation groups of the cationic material included in the print-characteristic improving liquid react mutually as ions to disperse the pigment to break, and the diameter of each pigment particle is extremely enlarged. Normally, in accordance with the above-described aggregation, the viscosity of the ink increases.

The above-described invention prevents image deterioration due to the distribution of ink concentration on the border between a region printed in one scan and another printing region, and executes bi-directional printing while reducing the color difference between printing directions, so that a high-quality output can be obtained at high speed.

BRIEF DESCRIPTION OF THE DRAWINGS

FIGS. 2A and 2B are charts illustrating the relationship between image data and the printing direction in an embodiment of the present invention.

FIGS. 8A to 8D are charts illustrating white blur generated in an image border.

FIGS. 9A to 9E are charts illustrating the relationship between the occurrence of white blur and a printing direction.

DESCRIPTION OF THE PREFERRED EMBODIMENTS

Embodiments of the present invention will be described below with reference to the accompanying drawings.

The direction in which printing with a printing-characteristic improving liquid is performed before printing with ink is hereinafter referred to as the "forward direction". The reverse direction in which printing with the printing-characteristic improving liquid is performed after printing with the ink is hereinafter referred to as the "backward direction". And, the direction in which either the forward or the backward direction is arbitrarily selected for printing is hereinafter referred to as the "arbitrary direction". Also, the scan operation in which printing is about to start is hereinafter referred to as "the present scan". Scanning in which printing was performed just before the present scan is hereinafter referred to as "the previous scan". And, the scan operation in which printing will start just after the present scan is hereinafter referred to as "the subsequent scan". In addition, a region having no image data is hereinafter referred to as a "break".

Figure 1:
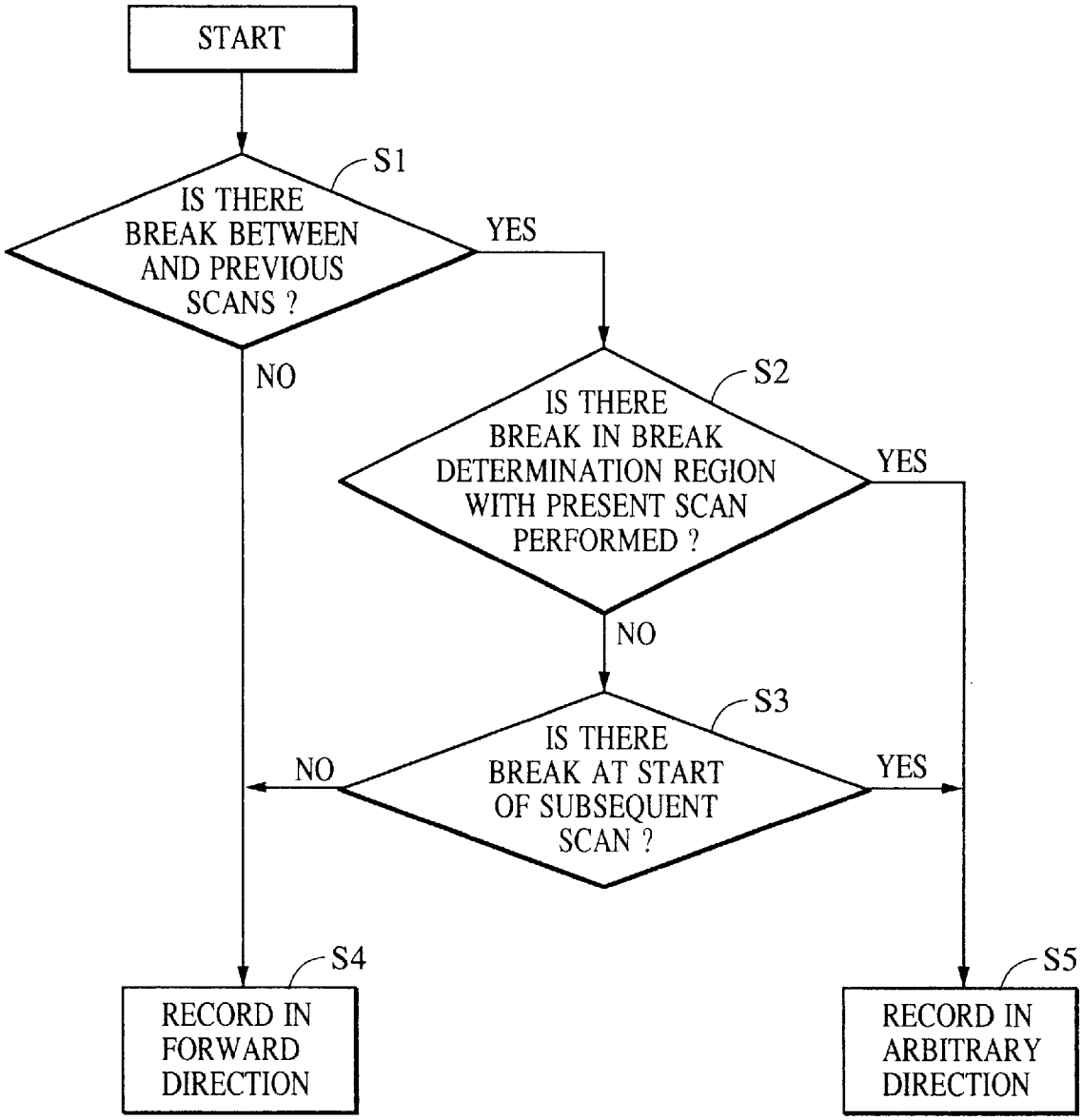
FIG. 1 is a flowchart showing a process for determining the printing direction, according to an embodiment of the present invention.

FIG. 1 shows a flowchart illustrating a process for determining the printing direction.

In determination step S1, the process determines whether or not a break exists between the previous scan and the present scan. If the break exists, the process proceeds to the next determination step S2. If the break does not exist, the printing direction in the present scan is determined to be the forward direction.

In determination step S2, the process determines whether or not a break is included in a break determination region with the present scan performed. Depending on the type of image data, there is a case where the whole of a region capable of being printed by one scan is not printed, but the forward and backward printing improves the throughput even if the printable region with one scan is reduced. Accordingly, the break determination region for determining the presence or absence of the break is provided in the present scan. If the break is included in the break determination region, the process proceeds to step S5, in which the image data up to the detected break is recorded in the arbitrary direction.

The arbitrary direction is selected so that recording by the present scan can be performed in the shortest time. In an ink-jet recording apparatus, not only a scanning operation for normal recording but also a preliminary discharging operation for discharging ink outside a printing region and a suction-restoration operation for sucking and evacuating the ink from a discharging outlet are performed in order to improve the reliability of recording. In many cases, the positions of units for performing the operations are fixed, while a carriage moves. When the carriage does not move in order to perform the preliminary discharging operation and the suction-restoration operation, the direction in which the present-scan printing can be performed in the shortest time is the reverse direction with respect to the printing direction in the previous scan. When the carriage moves between the previous scan and the present scan, the same direction as in the previous scan may be the direction in which recording can be performed in the shortest time.

In determination step S2, if the process has determined that the break is not included in the break determination region in the present scan, the process proceeds to determination step S3, where a determination of whether or not a break is found at the start of the subsequent scan is made. If a break is found, the process proceeds to step S5, in which recording is performed in the arbitrary direction. If a break is not found, the process proceeds to step S4, in which recording is performed in the forward direction.

A process for detecting the break will be described below.

FIGS. 2A and 2B show examples of printing. Regions a to h are areas where printing is performed by scanning one time with a recording head in the main-scan direction.

Tables in FIGS. 2A and 2B show whether the break is present or missing between the present scan and the previous scan or the subsequent scan in regions a to h.

Image data as shown in FIG. 2A are all recorded in the forward direction. Since there is no break at the connection between regions a and b, regions a and b are recorded in the forward direction. There is a break at the connection between regions b and c, but there is no break at the connection between regions c and d. Thus, both regions c and d are recorded in the forward direction.

Image data as shown in FIG. 2B are partly recorded in the arbitrary direction. Since there is no break at the connection between regions e and f, regions e and f are recorded in the forward direction. There is a break at the connection between regions f and g, and there is a break at the connection between regions g and h. Thus, region g is recorded in the arbitrary direction. There is no break at the connection between region h and the subsequent region to be scanned. Thus, region h is recorded in the forward direction.

Next, specific examples of a data management method and a data processing method for performing the printing operation will be described below.

Figure 3:
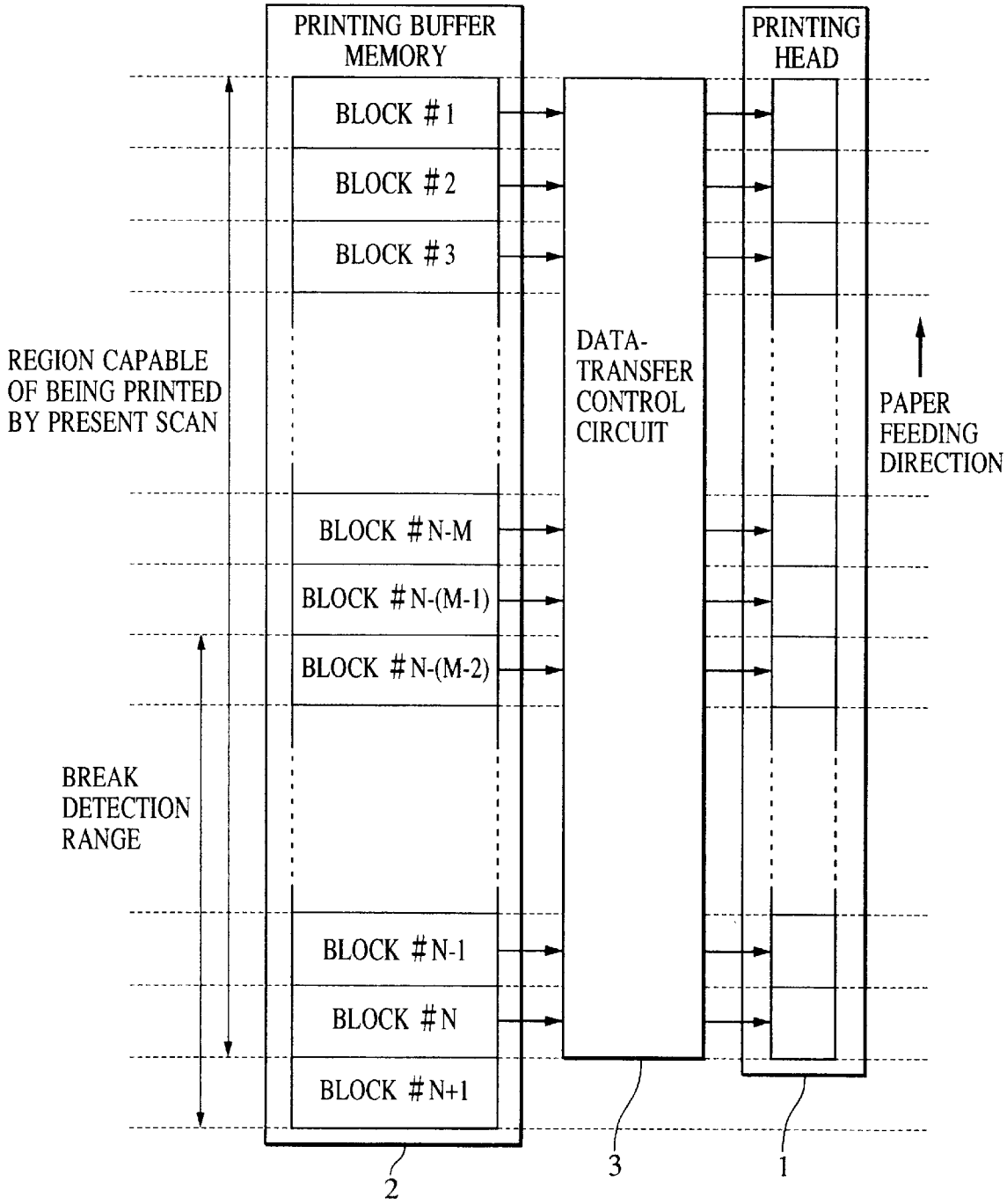
FIG. 3 is a block diagram showing a method for managing print data, according to an embodiment of the present invention.

FIG. 3 shows a block diagram illustrating a method for managing print data according to the embodiment of the present invention.

A printable range for one scan by the printing head is managed by being divided into blocks #1 to #N, and the printing data corresponding to the respective blocks are separately stored in a printing buffer memory 2. The printing data stored in the printing buffer memory 2 is sent to a printing head 1 via a data-transfer control circuit 3. The data-transfer control circuit 3 can control the data output to the printing head 1 block by block, and can selectively determine whether or not to record each block. In this embodiment, by referring to the data stored in the printing buffer memory 2 corresponding to each block, the data-transfer control circuit 3 determines whether or not printing data for each scan is successive, and uses the result to control the printing direction. When the printing data is not successive, there is a break, namely, a blank in an image.

The simplest way to detect whether or not there is a break between the printing region with the present scan and the printing region with the subsequent scan is to detect whether or not printing data is included in block #N as the end block of the printing data of N blocks capable of being printed by the present scan and block #N+1 as the subsequent block. However, if a break is detected and the forward direction printing can be performed, N blocks capable of being printed by the present scan are not all printed. Instead, the printing time can be shortened by printing the upper blocks rather than the break-detected block by the present scan, and printing the lower blocks and the break-detected block by the subsequent scan. For example, when blocks #N to #N+1 have printing data, printing all blocks #N to #N+1 by the present scan hinders the printing regions with the present scan and the subsequent scan from separating. However, for example, when block #N−1 has no printing data, by printing block #N−1 by the subsequent scan without printing block #N−1 by the present scan, the printing regions with the present scan and the subsequent scan can be separated. According to this embodiment, M blocks from the bottom among N blocks capable of being printed are used as a range from which a break is detected. In a case where there is block #X having no printing data in blocks #N-(M−1) to #N+1, only blocks #1 to #X−1 are printed with the present scan by setting the data-transfer control circuit 3, and the printing regions with the present scan and the subsequent scan are separated by printing the blocks after block #x+1 in the subsequent scan. Thereby, the forward printing can be performed to shorten the printing time. Here the region of M blocks from the bottom where a break is detected corresponds to "the break determination region" appearing in the above-described step S2 shown in FIG. 1.

Figure 4:
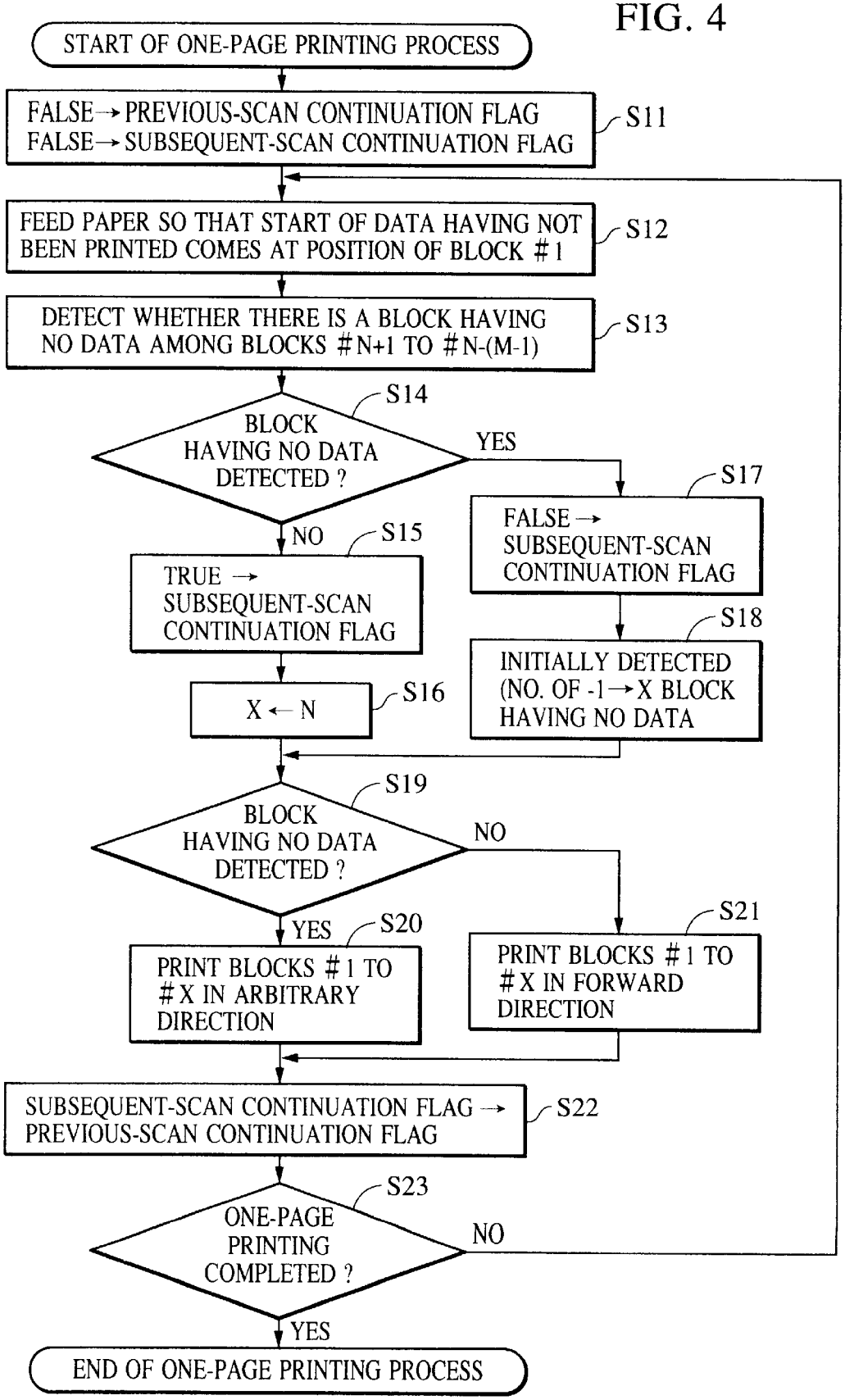
FIG. 4 is a flowchart showing a detailed process for performing a one-page printing operation, according to an embodiment of the present invention.

FIG. 4 shows a flowchart of a detailed process for performing one-page printing operation. In step S11, before the one-page printing operation, both a previous-scan continuation flag and a subsequent-scan continuation flag in a work memory are set to be false. The previous-scan continuation flag represents whether or not the printing data is continuous in the printing region with the present scan performed and the printing data in the printing region with the previous scan performed. The subsequent-scan continuation flag represents whether or not the printing data is continuous over the printing region with the present scan performed and the printing data in the subsequent scan performed.

In step S12, when the printing by one scanning starts, a paper feeding operation is executed so that the start of data which has not been printed comes at the position of block #1. In step S13, by referring to the printing data stored in the printing buffer from the bottom block #N+1 to the upper blocks, the process detects whether or not there is a block having no printing data among blocks #N+1 to #N-(M−1).

In step S14, if the block having no printing data is not detected, a condition is found in which the printing data in the present scan and the subsequent scan is continuous. Accordingly, in this case, in step S15, the subsequent-scan continuation flag is set to be true, and in step S16, N representing the bottom block of the printing head is substituted in the place of variable X representing the bottom block to be printed by the present scan.

If, however, in step S14, if the block having no printing data is detected, the printing data in the present scan and the subsequent scan can be separated with the data block as a boundary. In this case, in step S17, the subsequent-scan continuation flag is set to be false. In step S18, a number obtained by subtracting one from the number of the block having no recording data, initially detected in step S13, is substituted in the place of variable X representing the bottom block to be printed by the present scan.

In the above manner, detection of whether the present scan and the subsequent scan are continuous or there is a break between them is performed, and the result determines the value of the subsequent-scan continuation flag. In addition, the previous-scan continuation flag has been determined to represent whether or not the present scan and the previous scan are continuous. Thus, in step S19, by verifying whether or not both the previous scan flag and the subsequent scan flag are false, the process can determine whether or not the present scan is independent from the previous scan and the subsequent scan. In step S20, if both the previous scan flag and the subsequent scan flag are false, the present scan is independent from the previous scan and the subsequent scan. Thus, blocks #1 to #X are printed in the arbitrary direction. In addition, in step S19, if either the previous-scan continuation flag or the subsequent scan continuation flag is true or both flags are true, printing in the arbitrary direction cannot be performed. Thus, in step S21, blocks #1 to #X are printed in the forward direction. After printing by scanning one time, the subsequent-scan continuation flag can be used as the previous-scan continuation flag in the printing operation by the subsequent scan. Thus, in step S22, the previous-scan continuation flag is updated with the subsequent-scan continuation flag.

By repeating steps S12 to S22 a required number of times for scanning until the answer to determination in step S23 is yes, recording for one page is completed.

It will be appreciated that those skilled in the art of computer programming, especially computer programming of the type now used to control ink jet printers, would, in view of the foregoing flowcharts and discussion, be able to implement this recording method. That is, and ink jet printer controller could be suitably programmed using known techniques to implement the recording method of this invention, in view of this disclosure.

Figure 5:
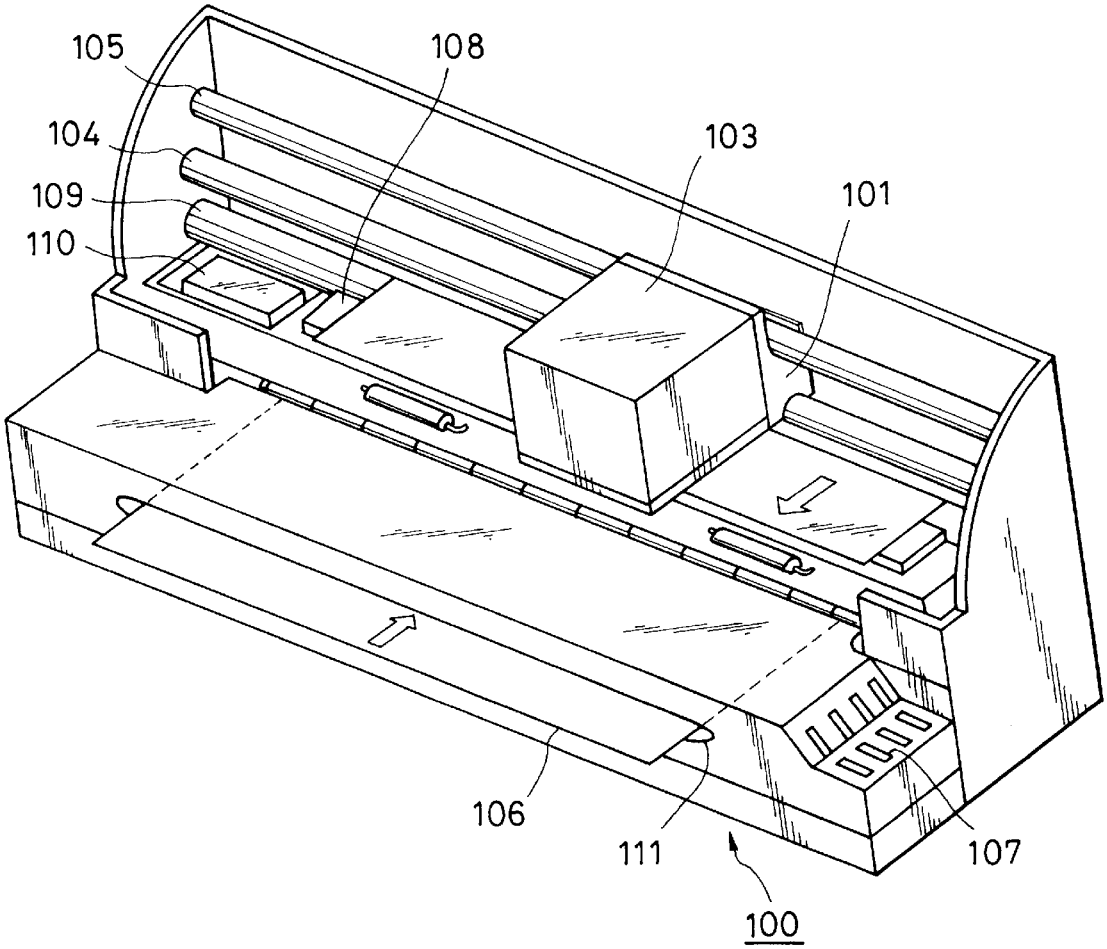
FIG. 5 is a perspective view showing an ink-jet recording apparatus according to an embodiment of the present invention.

FIG. 5 shows an ink-jet recording apparatus according to an embodiment of the present invention. In the ink-jet recording apparatus 100, a recording medium 106 inserted at a feeding position 111 is fed by a feeding roller 109 to the recording region of a recording head unit 103. Platen 108 is provided beneath the recording medium in the recording region. A carriage 101 provided so as to move in the direction determined by two guide shafts 104 and 105 scans the recording region back and forth. The carriage 101 is provided with recording heads for discharging a plurality of color inks and print-characteristic improving liquid (S), and the recording head unit 103 including an ink tank for supplying the recording heads with the inks and the print-characteristic improving liquid (S). The ink-jet recording apparatus according to this embodiment uses the following four color inks: black (Bk), cyan (C), magenta (M) and yellow (Y).

There is a restoration system unit 110 at the lower left-end of the region in which the carriage 101 can move. When recording is not performed, the restoration system unit 110 positioned at the lower left end of the region in which the carriage 101 caps the discharge outlet of the recording head, and so forth. The left end is called the "recording-head home position". Switching/display units 107 consist of a switching unit used to switch the main power of the recording apparatus 100, and a switching unit for displaying the condition of the recording apparatus 100.

Figure 6A:
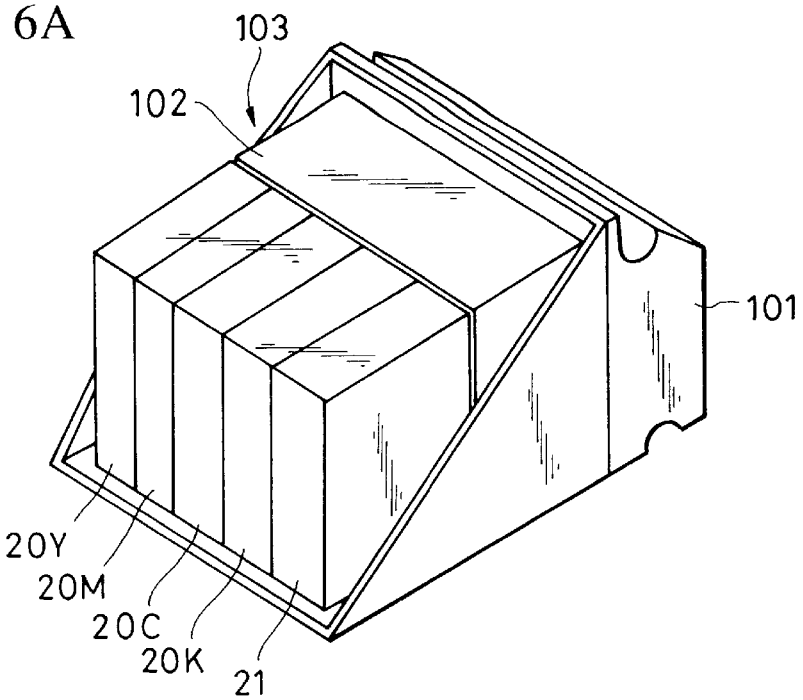
FIG. 6A is a perspective view showing a recording head unit according to the present invention.

FIG. 6A shows a perspective view of the recording head unit 103, in which all the containers for the inks Bk, C, M and Y, and the print-characteristic improving liquid S are independently replaceable. The carriage 101 is provided with recording heads 102, the Bk container 20K, the C container 20C, the M container 20M, the Y container 20Y, and the print-characteristic-improving-liquid container 21. The containers 20K, 20C, 20M, 20Y and 21 are connected to the recording heads, and their outlets are supplied with the inks and the print-characteristic improving liquid. Alternatively, the print-characteristic-improving-liquid container 21 and the Bk container 20K may be incorporated as a single structure.

Figure 6B:
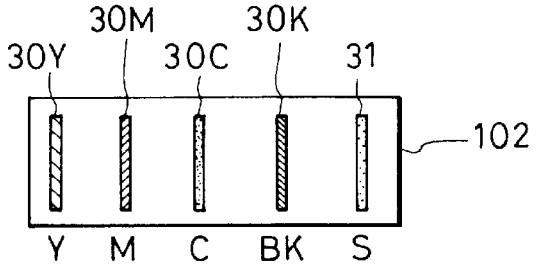
FIGS. 6B to 6E are plan views showing discharge-outlet surfaces for a recording head according to the present invention.

FIG. 6B shows the discharge-outlet surface (opposed to the recording medium) of the recording heads 12. Recording heads 30K, 30C, 30M and 30Y respectively discharge Bk, Ck, M and Y inks, and a head 31 discharges the print-characteristic improving liquid.

Figure 6C:
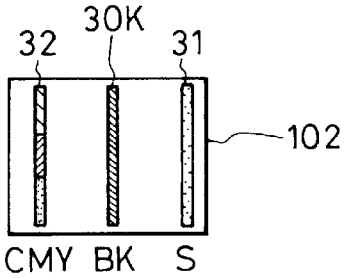
Figure 6D:
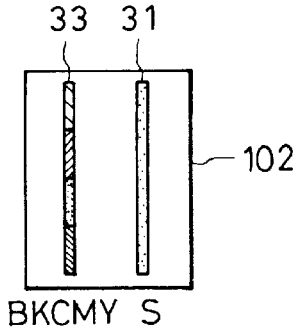
Figure 6E:
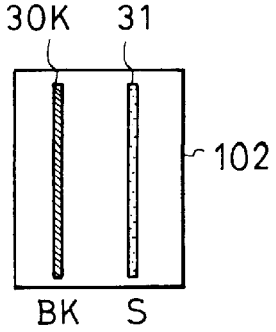

In addition, according to the present invention, a head 32 incorporating the C, M and Y heads as shown in FIG. 6C, or a head 33 formed by incorporating the Bk, C, M and Y heads as shown in FIG. 6D may be used. Alternatively, a monochrome head 30K as shown in FIG. 6E may be used. In any of the head structures the recording-ink discharge heads and the print-characteristic-improving-liquid discharge head are arranged in parallel in the main-scan direction. The heads may be incorporated by combining single heads, or one head may be provided with a plurality of discharge outlets for inks.

Figure 7:
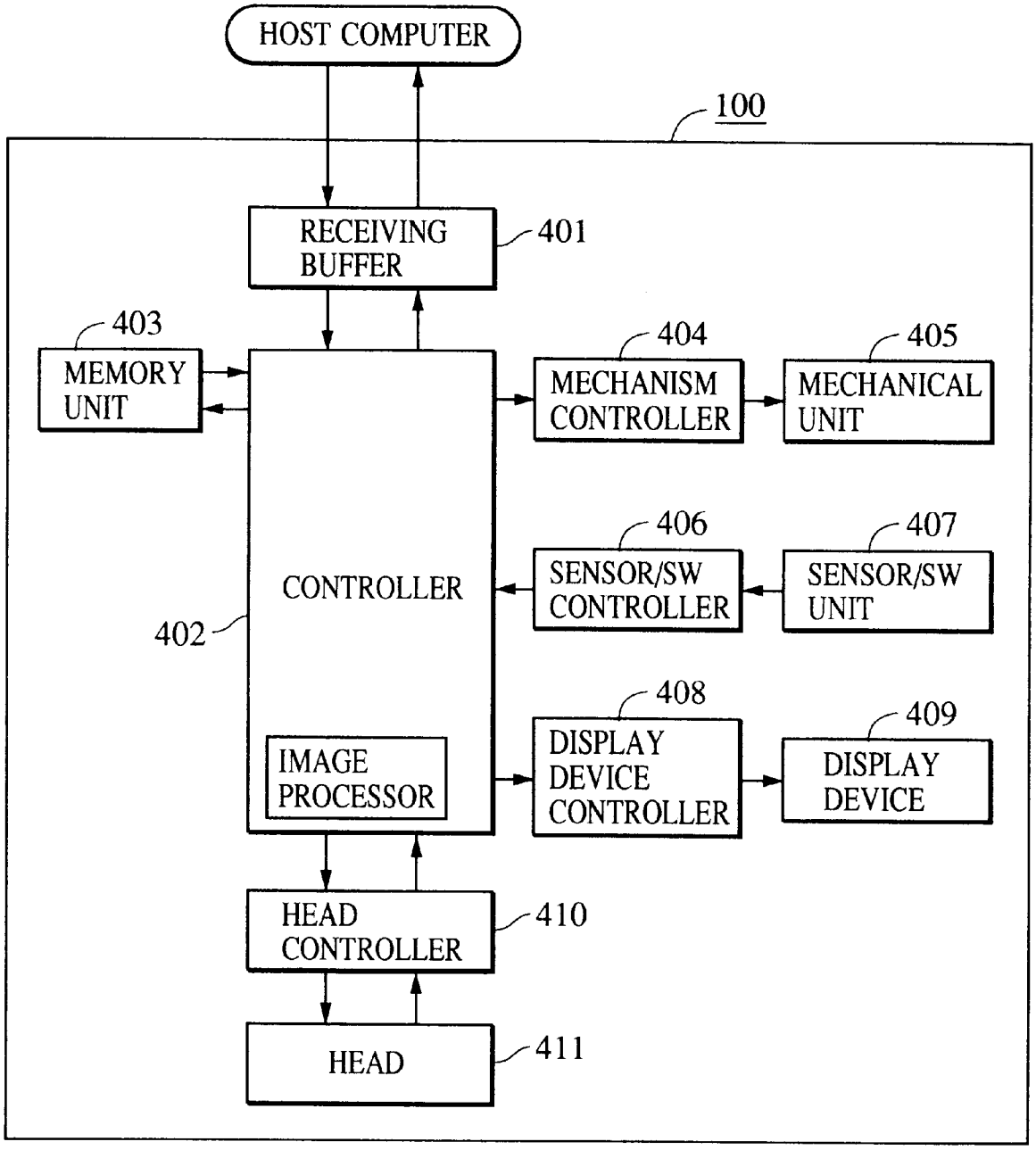
FIG. 7 is a block diagram showing a recording apparatus according to an embodiment of the present invention.
Figure 10:
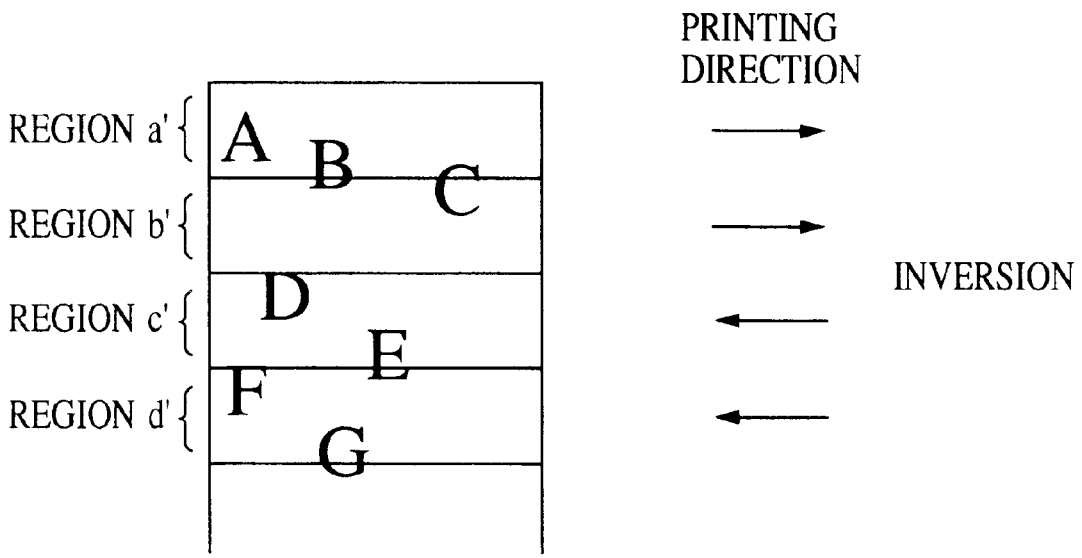
FIG. 10 PRIOR ART
FIG. 10 is a chart illustrating one example of the relationship between image data and a printing direction when bi-directional printing is performed by a conventional recording method.

FIG. 7 shows a block diagram of the ink-jet recording apparatus 100 according to the embodiment of the present invention. Image data to be recorded is input from a host computer to a receiving buffer 401 in the ink-jet recording apparatus 100. Data enabling confirmation of whether or not the image data is normally transferred, and data for notification of the operating condition of the recording apparatus 100 are output to the host computer. The image data stored in the receiving buffer 401 is transferred to a memory unit 403 under control of a controller 402 including a central processing unit (not shown), and is temporarily stored in the random access memory (not shown) of the memory unit 403. In accordance with a command from the controller 402, a mechanism controller 404 drives a mechanical unit 405 such as a carriage motor or a line-field motor. A sensor/switch (SW) controller 406 sends a signal from a sensor/SW unit 407 to the controller 402. A display device controller 408 controls a display device including light emitting diodes and a liquid-crystal display device of display panels in accordance with a command from the controller 402. A (recording) head controller 410 controls (recording) heads 411 in accordance with a command from the controller 402, and transmit information such as temperature information representing the condition of the heads 411, to the controller 402.

Ink-jet recording methods applicable to the present invention include a method in which devices (e.g., electric heat converter, and a laser) for generating heat energy as energy used to discharge ink are used, and a change in the condition of the ink is caused by the heat energy. The method can achieve high-density, highly-detailed recording.

For example, the basic principles disclosed in U.S. Pat. Nos. 4,723,129 and 4,740,796 are preferably used as the typical structure and principle of the above-mentioned method. The above-mentioned method can be applied to either a on-demand type or continuous type recording device. In particular, in the case of the on-demand type device, by applying at least one driving signal, corresponding to recording information, for providing a rapid temperature rise exceeding film boiling, to an electric heat converter disposed to correspond to a liquid (ink)-held sheet or liquid path, heat energy can be generated in the electric heat converter, and film boiling can be generated on a surface on which the recording head heat acts. This is effective because a bubble in the liquid (ink) corresponding to the applied signal can be formed. By using the growth and contraction of the bubble to discharge the liquid (ink) via the discharge opening, at least one drop is formed. If the driving signal is in the form of pulses, the bubble can be instantaneously and properly grown and contracted. This enables liquid (ink) to be discharged in a highly responsive manner, which, it will be understood, is quite desirable.

Concerning the pulse-form driving signal, signals such as those described in U.S. Pat. Nos. 4,463,359 and 4,345,262 are proper. In addition, by employing conditions like those described in U.S. Pat. No. 4,313,124 with regard to the temperature rise rate on a surface on which recording heat acts, more superior recording can be performed.

Concerning the structure of the head 411 used with this invention, not only a combination (linear liquid path or perpendicular liquid path) of the structures of a discharge outlet, a liquid path and an electric converter as disclosed in each of the above United States patents but also structures disclosed in U.S. Pat. Nos. 4,558,333 and 4,459,600 on the arrangement of a heat-acted surface in a bending region are suitable. In addition, the present invention may be constructed in the manner of Japanese Patent Laid-Open No. 59-123670 disclosing a structure in which slots common to a plurality of electric heat converters are used as the discharge outlets of the electric heat converters, and Japanese Patent Laid-Open No. 59-38461 disclosing a structure in which an opening for absorbing electric-heat pressure waves is correlated with a discharge outlet.

In addition, an exchangeable chip-type recording head which can be electrically connected to the recording-apparatus body and which can be supplied with ink from the recording-apparatus body when the recording head is mounted upon the recording-apparatus body, or a cartridge-type recording head with an ink container incorporated therein may be used.

Moreover, the mode of the recording apparatus of the present invention may be one used as the image output terminal of an information processing apparatus like a computer, a photocopier combined with a word processor, a reader and so forth, and the recording means of a facsimile apparatus having transmission and receiving functions.

Figure 11:
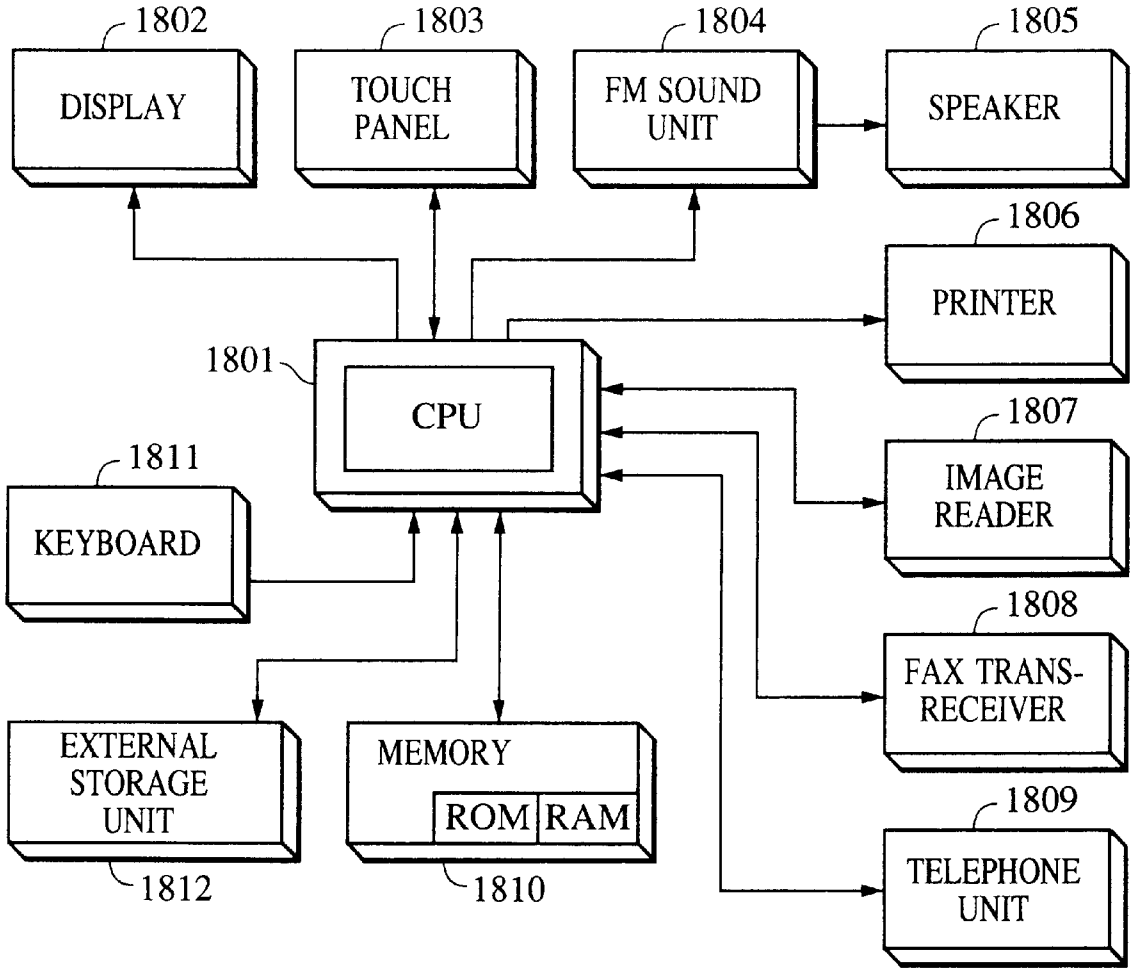
FIG. 11 is a block diagram showing a case in which a recording apparatus according to the present invention serves as a recording means for an information processing system having word-processor, personal computer, facsimile and photocopier functions.

FIG. 11 is a block diagram of showing information processing apparatus having functions as a word processor, a personal computer, a facsimile apparatus and a photocopier, in which the recording apparatus of the present invention is used.

A controller 1801 including a central processing unit (CPU) and various types of input/output ports controls other units by outputting control signals and data signals to the other units, and receiving control signals and data signals input from the other units. A display 1802 projects various menus, document information and image data read with an image reader 1807 on its display screen. A transparent pressure-sensitive touch panel 1803 is mounted on the display 1802. By pressing the surface of the touch panel 1803, items and coordinate positions can be input on the display 1802.

A frequency modulation (FM) sound unit 1804 stores music information made with a music editor in a memory 1810 or an external storage unit 1812, and reads the stored information from them in order to perform the frequency modulation of it. An electric signal from the FM sound unit 1804 is converted to audio sound by a speaker 1805. A printer 1806 is an output terminal as recording means for word processor, personal computer, facsimile and photocopier functions, to which the recording apparatus of the present invention is applied.

The image reader 1807 is provided in the middle of a carrier path, for input by photoelectrically reading subject-copy data, and reads various types of subject copies such as a facsimile subject copy and a reproduction original copy. A facsimile (FAX) trans-receiver 1808 having an interface function with the exterior performs the facsimile transmission of the subject copy read by the image reader 1807, and receives and decodes transmitted facsimile signals. A telephone unit 1809 has various types of functions such as an ordinary telephone function and an automatic answering function.

The memory 1810 includes a read-only memory (ROM) holding a system program, a manager program, applications, character fonts, dictionaries, and so forth, and a random access memory (RAM) holding applications, document information and video information, loaded from the external storage unit 1812.

A key board 1811 is used to input document information, various commands, and so forth.

The external storage unit 1812 uses a floppy disc or hard disc as a storage medium. Information such as document information, music or sound information, and/or the user's applications are stored in the external storage unit 1812.

Figure 12:
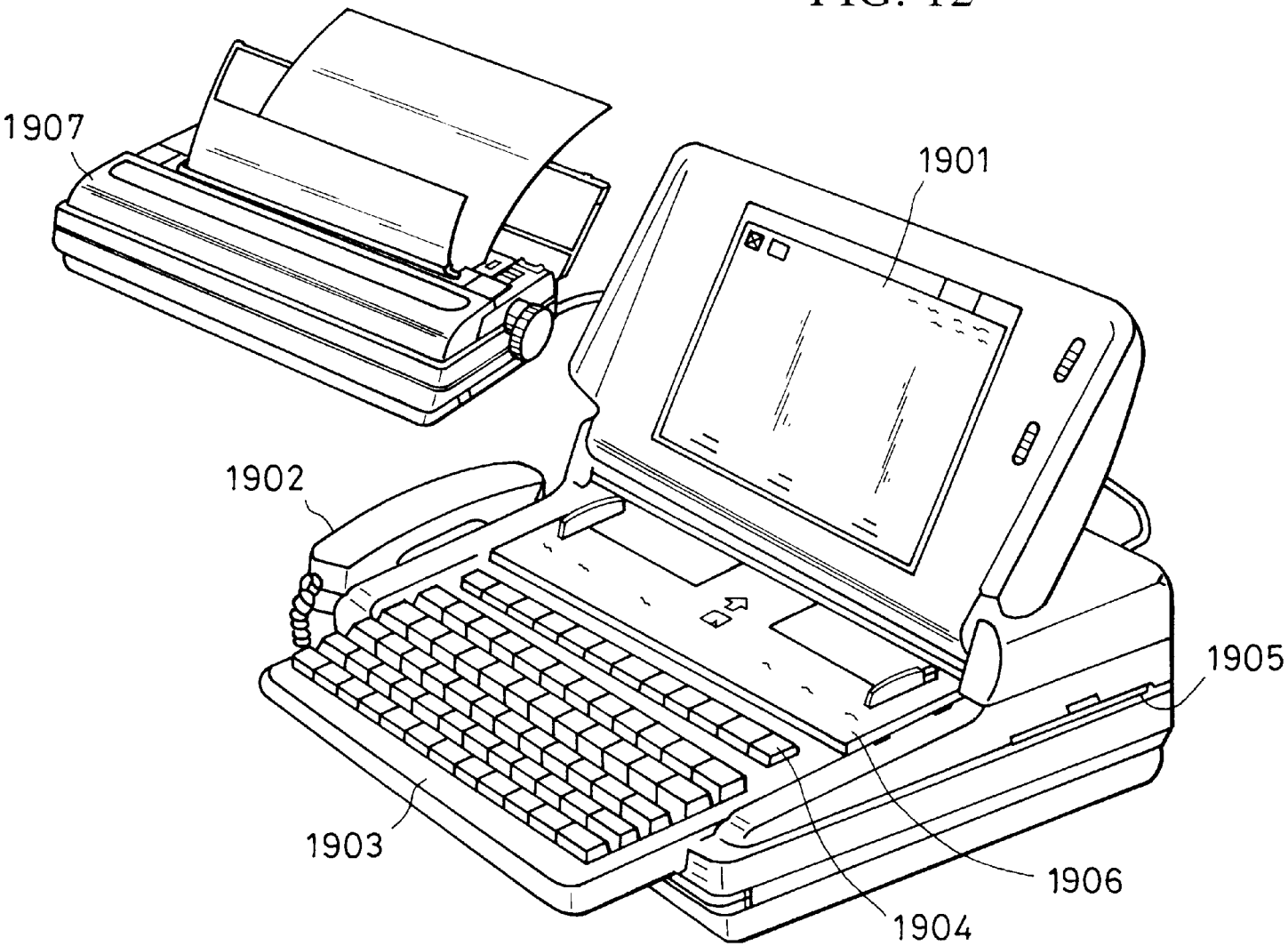
FIG. 12 is a perspective view showing the exterior of the information processing system shown in FIG. 11.

FIG. 12 shows the schematic exterior of the information processing apparatus shown in FIG. 11.

On a flat-panel display 1901 using liquid crystal or the like, various menus, figure information, document information and so forth are projected. The touch panel 1803 shown in FIG. 11 is mounted on the display 1901. By pressing the surface of the touch panel 1803, coordinates and items can be input. A handset 1902 is provided so that a telephone function can be used. A key board 1903 is connected to the main body by a cord so as to be taken off from the main body, and enables inputting various document information and various data. The key board 1903 is provided with various function keys 1904. An insertion opening 1905 allows a floppy disc, which is a form of external storage unit 1812 shown in FIG. 11, to be used.

A subject-copy holder 1906 is used to hold a subject copy to be read by the image reader 1807. The read subject copy is ejected from the back of the information processing apparatus. When facsimile transmission is received, an ink-jet printer 1907 prints the transmitted image.

The display 1802 may comprise a cathode-ray tube. However, it is preferable to use a flat-panel type such as a liquid crystal display using ferroelectric liquid crystals because it enables not only size reduction and thickness reduction but also weight reduction.

When the information processing apparatus functions as a personal computer or word processor, various information input from the key board 1811 is processed in accordance with predetermined programs by the controller 1801, and the processed information is output as an image by the printer 1806.

When the information processing apparatus functions as a facsimile receiver, facsimile information input from the FAX trans-receiver 1808 via a communication line is processed for receiving in accordance with predetermined programs by the controller 1801, and the processed information is output as a received image by the printer 1806.

When the information processing apparatus functions as a photocopier, the subject copy is read by the image reader 1807, and the read subject copy is output as a copy image by the printer 1806 via the controller 1801. When the information processing apparatus functions as a facsimile transmitter, subject-copy data read by the image reader 1807 is processed for transmission in accordance with predetermined programs, and the processed data is transmitted to the communication line by the FAX trans-receiver 1808.

Figure 13:
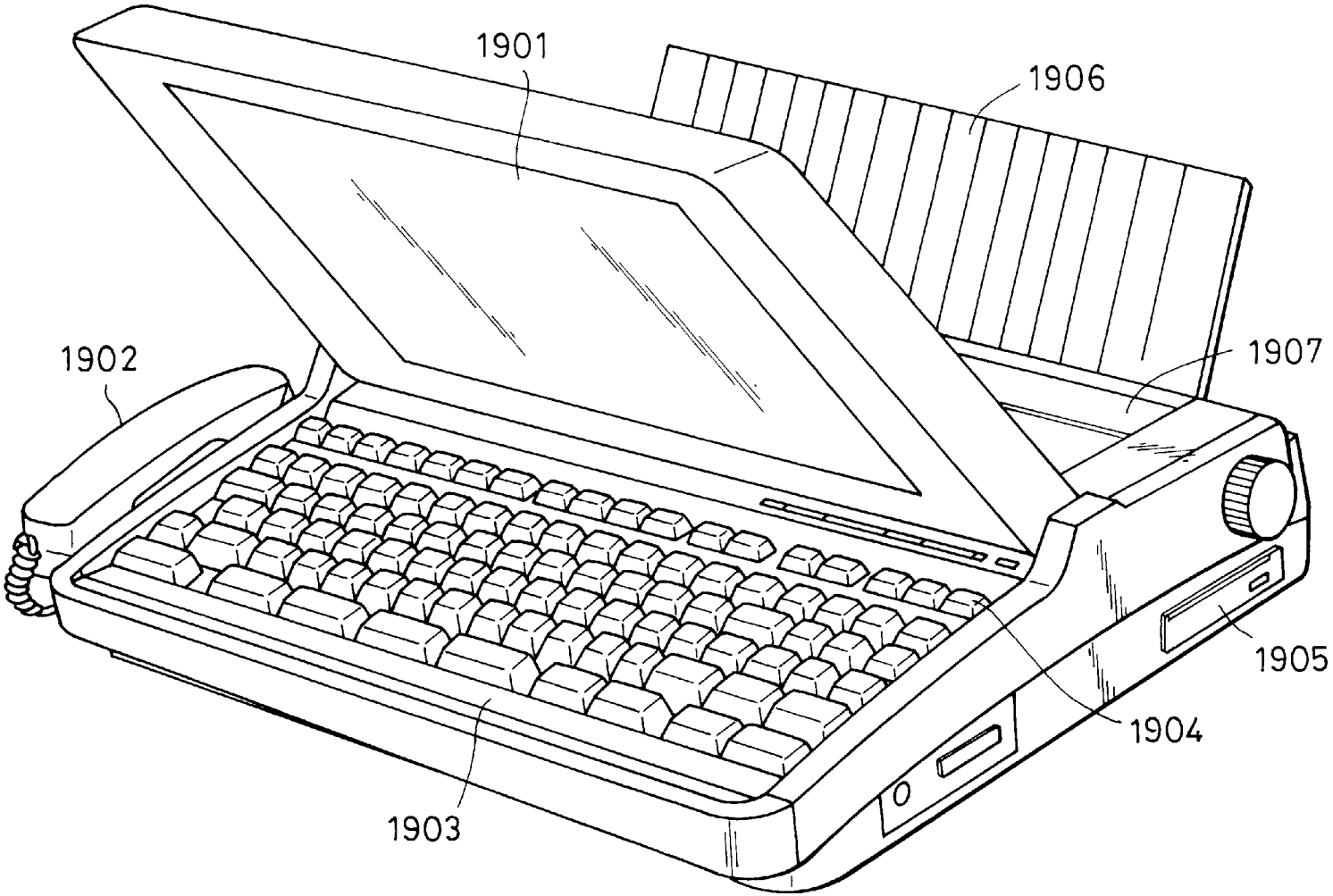
FIG. 13 is a perspective view showing one example in which a recording apparatus of the present invention serves as a recording means for an information processing system.

As shown in FIG. 13, the above-described information processing apparatus may have a built-in structure in which the ink-jet printer is included in the information processing apparatus, which enhances portability. In FIG. 13, portions having functions identical to those shown in FIG. 12 are denoted by the corresponding reference numerals.

As described above, by applying the ink-jet printer of the present invention to the multi-functional information processing apparatus, a high-quality printed image can be obtained at high speed, with low noise. Thus, the functions of the above-described information processing apparatus can be further improved.

According to the present invention, the presence or absence of consecutive data selects the printing direction, which enables printing in two directions. Thus, a high-quality image can be obtained at high speed.

What is claimed is:

1. An ink-jet recording method for recording an image by applying an ink and a print-characteristic improving liquid for improving a print-characteristic of the ink onto a recording medium, the ink and the print-characteristic improving liquid being applied onto the recording medium at a substantially same region on said recording medium, the method comprising the steps of:

dividing a recording range into a plurality of regions before performing either a first step of applying said print-characteristic improving liquid and then said ink to a divided region, in that order, or a second step of applying said ink and then said print-characteristic improving liquid to a divided region, in that order;

determining if an image which is continuous over adjacent ones of said regions exists on a border between the adjacent regions; and in a case where the determining step determines that said continuous image does not exist on the border between a first region to be recorded and a second region to be recorded subsequent to the first region, and said continuous image does not exist on the border between said second region and a third region to be recorded subsequent to the second region, performing the second step to record said second region, and performing the first step to record said first and third regions.

2. An ink-jet recording method according to claim 1, wherein said print-characteristic improving liquid comprises a material causing a coloring material in said ink to become insoluble or to aggregate.

3. An ink-jet recording method according to claim 1 or 2, wherein said print-characteristic improving liquid further comprises a surface active agent.

4. An ink-jet recording method according to claim 1, wherein said ink and said print-characteristic improving liquid are applied using heat energy to discharge said ink and said print-characteristic improving liquid.

5. An ink-jet recording method according to claim 1, wherein the first step is performed to record the first and third regions by applying said print-characteristic improving liquid image and said ink along a first direction to individual ones of those regions, and the second step is performed to record the second region by applying said print-characteristic improving liquid and said ink along a second direction to the second region.

6. An ink-jet recording apparatus for recording an image by applying an ink and a print-characteristic improving liquid for improving a print-characteristic of the ink onto a recording medium, the ink and the print-characteristic improving liquid being applied onto the recording medium at a substantially same region on said recording medium by discharging said ink and said print-characteristic improving liquid from a recording head, recording being performed by dividing a recording range into a plurality of regions before performing either a first step of applying said print-characteristic improving liquid and then said ink to a divided region, in that order, or a second step of applying said ink and then said print-characteristic improving liquid to a divided region, in that order, said ink-jet recording apparatus comprising:

a determiner for determining if an image which is continuous over adjacent ones of said regions exists on a border between said adjacent regions; and a recording controller for causing the first and second steps to be performed in a case where said determiner determines that said continuous image does not exist on the border between a first region and a second region to be recorded after said first region, and that said continuous image does not exist on the border between said second region and a third region to be recorded after said second region, wherein the second step is performed to record said second region, and the first step is performed to record said first and third regions.

7. An ink-jet recording apparatus according to claim 6, wherein said determiner performs the determining step based on data of an image to be recorded in said adjacent regions.

8. An ink-jet recording apparatus according to claim 6, wherein said print-characteristic improving liquid comprises a material causing a coloring material in said ink to become insoluble or to aggregate.

9. An ink-jet recording apparatus according to claim 6, wherein said print-characteristic improving liquid further comprises a surface active agent.

10. An ink-jet recording apparatus according to claim 6, wherein said recording head comprises a heat energy generator for generating heat energy to be used for discharging said ink and said print-characteristic improving liquid.

11. An ink-jet recording apparatus according to claim 6, wherein said ink-jet recording apparatus is a recording device for a facsimile apparatus.

12. An ink-jet recording apparatus according to claim 6, wherein said ink-jet recording apparatus is a recording device for a photocopier.

13. An ink-jet recording apparatus according to claim 6, wherein said ink-jet recording apparatus is a recording device for a word processor.

14. An ink-jet recording apparatus according to claim 6, wherein the first step is performed to record the first and third regions by applying said print-characteristic improving liquid image and said ink along a first direction to individual ones of those regions, and the second step is performed to record the second region by applying said print-characteristic improving liquid and said ink along a second direction to the second region.

* * * * *